United States Patent [19]

Brewer

[11] 4,235,457

[45] Nov. 25, 1980

[54] BOOK READERS CLIP

[76] Inventor: Jack J. Brewer, 5012 Oak Timers Ct., Colleyville, Tex. 76034

[21] Appl. No.: 16,943

[22] Filed: Mar. 2, 1979

[51] Int. Cl.[3] ..... B42D 9/00

[52] U.S. Cl. ..... 281/42; 24/67.3

[58] Field of Search ..... 24/67.3, 67.5, 67.7, 24/67.9, 61.11, 81 AD, 81 AE, 81 PC; 281/42

[56] References Cited

U.S. PATENT DOCUMENTS

| | | | |
|---|---|---|---|
| 316,499 | 4/1885 | Thomas | 281/42 |
| 330,402 | 11/1885 | Hunsaker | 281/42 |
| 2,278,143 | 3/1942 | Matthews | 281/42 |
| 2,455,515 | 12/1948 | Miller | 24/67.3 |

*Primary Examiner*—Paul A. Bell
*Attorney, Agent, or Firm*—H. Mathews Garland

[57] ABSTRACT

A readers clip for holding the pages of a book open at a desired place comprising an integral wire article having a straight back tine, a front page retainer having book gripping portions and lateral page holding portions, and a coil spring portion connecting the upper end of the tine with the upper end of the page retainer biasing the tine and page retainer together. The tine fits down the spine of a book while the front page retainer extends downwardly along the front of the book spine with the lateral portions overlying and holding adjacent open pages at a desired location in the book.

3 Claims, 3 Drawing Figures

BOOK READERS CLIP

This invention relates to an article for marking and holding a book open at a desired location while the book is read.

A number of different designs of book marker devices have been described and illustrated in previously issued patents. Some of these devices include several different parts which increase the cost of production and must be kept up with during the use of the devices. Other such devices may be formed of a single length of wire material but are not shaped to securely grip the book while holding the pages open at the desired location.

It is an especially important object of this invention to provide a new improved book readers clip.

It is another object of this invention to provide a book readers clip which is formed of a single length of spring-like wire material.

It is another object of the invention to provide a book readers clip which securely grips a book while holding opposing facing pages of the book open while such pages are read.

It is another object of the invention to provide a book readers clip having a straight back tine and a front clip and page holder portion which has lateral arms for holding opposing book pages open and longitudinal bent portions for engaging the book along the spine between the opposing pages to hold the clip on the book.

It is another object of the invention to provide a book readers clip which has a coil spring portion between a back tine and a front clip and page retainer biasing the tine and the clip page retainer together for securely gripping the book and holding the pages open.

In accordance with the invention there is provided a book readers clip formed of integral spring-like wire having a back straight tine, a front retainer clip and page holder comprising bent book engaging portions and lateral page holding arms, and a connecting coil spring portion between the upper end of the back tine and the clip and page holder biasing the tine and clip and page holder together.

The foregoing objects and advantages of the invention will be better understood from the following detailed description thereof taken in conjunction with the accompanying drawings wherein.

Figure 1:
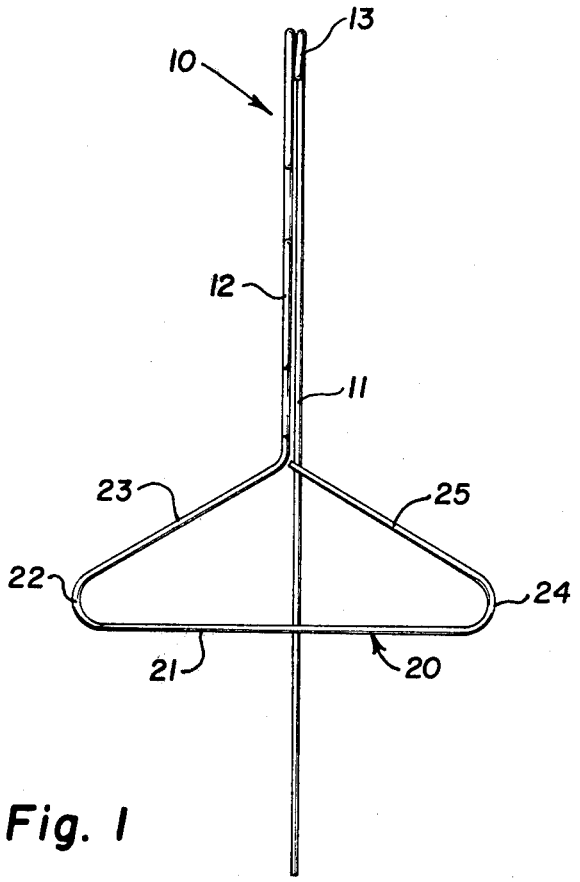
FIG. 1 is a front view in elevation of the book readers clip formed in accordance with the invention.
Figure 2:
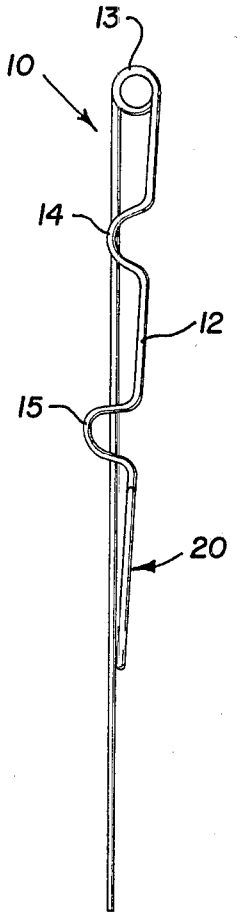
FIG. 2 is a left side view in elevation of the readers clip of FIG. 1.

Referring to FIGS. 1 and 2 of the drawings, a readers clip 10 embodying the features of the invention includes a back tine 11, a front clip and page holder 12, and a connecting coil spring portion 13. The back tine 11 is a straight member which is approximately one-third longer than the front clip and page holder portion. The clip and page retainer 12 includes two longitudinally spaced U-shaped bends 14 and 15 extending from the longitudinal axis of the member 12 toward the back tine 11. The bend 15 is preferably approximately twice as deep as the bend 14 for purposes to be discussed in connection with the use of the readers clip. The front clip and page holder portion 12 has a lateral page retainer or holder portion 20 formed at the free end of the member 12 comprising a generally triangular shaped member extending across or laterally relative to the tine 11 and the main portion of the member 12 approximately equidistant toward the opposite sides of the tine 11 and member 12 as evident in FIG. 1. The triangular portion 20 is formed of a base lateral section 21, a bend 22, a leg portion 23 connecting the portion 20 with the main body of the member 12, another bend 24, and an end leg portion 25 disposed at substantially the same angle with the main portion of the member 12 as the leg portion 23. The coil spring portion 13 is formed to bias the tine 11 and the clip and page holder member 12 together as shown in FIG. 2 with the portion 21 of the page retainer section 20 urged against the front face of the tine 11. This is the position assumed by the members when the readers clip is not in use as represented in FIGS. 1 and 2.

Figure 3:
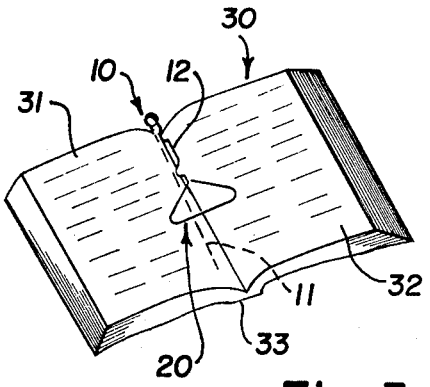
FIG. 3 is a reduced perspective view showing the readers clip in use on a book holding opposing pages open.

The readers clip 10 is used to hold opposing adjacent pages of a book open while the pages are read. The spine 11 and the clip and page holder member 12 are spread apart preferably by grasping the cross member portion 20 pulling the member 12 forward away from the tine 11 while the tine is extended down the spine of a book along the outside cover of the spine or inserted within the spine between the outside cover and the stitching along the secured edges of the pages. The clip and page holder member 12 is extended down the front of the book with the straight portion of the member 12 extending along the front of the book spine at the bases of the adjacent facing pages and the lateral page holding portion 20 of the member 12 overlapping the adjacent opposing pages. FIG. 3 illustrates the readers clip 10 engaged on a book 30 holding opposing adjacent pages 31 and 32 open while the pages are read. The tine 11 of the clip extends down the back of the book spine 33 while the upper straight portion of the member 12 with the bends 14 and 15 extends along the front of the spine between the base secured edges of the pages 31 and 32. The retainer bends 14 and 15 extend into the V-shaped trough defined along the base adjoining edges of the opposing pages 31 and 32. The page holder or retainer portion 20 extends laterally outwardly overlying and engaging portions of both the opposing pages 31 and 32 for tightly holding the pages in place. Because of the natural curved shape assumed by the pages 31 and 32 as they extend into the V-shape where the pages join along the book spine, the lateral page retainer portion 20 of the member 12 is held forwardly of the book spine at a distance greater from the tine 11 than the portion of the member 12 which joins the coil spring 13 so that the member 12 converges at an angle toward the tine 11. Because of the angle formed between the member 12 and the tine 11 when the clip is engaged on a book as shown in FIG. 3, the relative depths of the bends 14 and 15 cause the bends to tightly engage the book at the spine where the secured edges of the pages come together. With the bends 15 being approximately twice as deep as the bends 14, both the bends 14 and 15 will tightly engage the book along the junction of the secured edges of the pages. If the bend 14 and the bend 15 were the same depth, it will be apparent that the bend 14 would tend to hold the clip member 12 out sufficiently away from the book pages that the bend 15 would be of little or no value in engaging the book. Thus the relative proportions between the bends 14 and 15 are important to the proper functioning of the clip. With the bends 14 and 15 tightly engaging the joining secured edges of the pages 31 and 32, the readers clip 10 is held tightly on the book while the lateral page holder portion 20 holds the pages 31 and 32 open for reading. The readers clip is taken off the book and reinstalled when the pages are turned. Since the member 12 is substantially larger than the tine 11, it is not necessary to fully disengage the clip from the book. The lower free end portion of the tine 11 may remain engaged with the book spine while the clip is raised sufficiently to disengage the lateral page retainer portion 20 from the pages to turn the pages after which the clip is pushed back downwardly to the position shown in FIG. 3.

The book readers clip of the invention permits a book to be held open fully exposing the desired pages without actually holding the book in the readers hands. The clip permits the book to lie flat and be read while the reader does something else with his or her hands. The use of several such clips allows several books to be opened at marked locations for reference purposes while the reader is writing.

The book readers clip of the invention works equally well on paper back and hard bound books. Hard bound books normally have a cover along the outside of the book spine which is separate from the secured page edge binding into which the straight back tine of the clip is insertable. Paper back books in contrast do not have a separate cover but rather the page binding and back book binding along the spine of the book are integral. The readers book clip of the present invention works just as well with the paper back as with the hard bound book.

The use of the bends 14 and 15 with bend 14 being approximately half the depth of the bend 15 the readers clip readily fits to properly hold pages open near the beginning and near the end of a book where otherwise if the bends were the same depth or if there were no bends in the retainer member 12, the clip would tend to slip laterally and would not remain firmly fixed on the book.

What is claimed is:

1. A book readers clip for holding the pages of a book open at a desired location comprising: an integral spring wire article having a straight back tine, a coil spring formed at one end of said tine, a retainer and page holder member substantially shorter than said back tine and secured with said coil spring at one end and extending along said tine including a laterally extending page holder portion formed on the free end of said retainer member and a plurality of spaced bends each having a substantially U-shape formed in said retainer member between said coil spring and said lateral page holding portion of said member, said bends extending toward said tine and said bend nearest said coil spring being approximately one-half the depth of the other of said bends, said coil spring biasing said retainer member toward said tine.

2. A book readers clip in accordance with claim 1 wherein said lateral page holding portion of said retainer member is a triangular shaped bend along the free end of said member having a lateral portion extending substantially perpendicular to the body of said member and said tine and angular side portions, one of said side portions connecting with the main portion of said retainer member and the other opposite of said side portions forming the end portion of said retainer member.

3. A book readers clip in accordance with claim 2 wherein said retainer member is substantially two-thirds the length of said tine.

* * * * *